US012319528B2

(12) United States Patent
Egawa

(10) Patent No.: US 12,319,528 B2
(45) Date of Patent: Jun. 3, 2025

(54) POST-PROCESSING DEVICE THAT CONTROLS TIMING THAT AIR BLOWER FORMS AIR LAYER BETWEEN UPPER FACE OF FIRST RECORDING SHEET AND LOWER FACE OF SECOND RECORDING SHEET, AND IMAGE FORMING SYSTEM

(71) Applicant: KYOCERA Document Solutions Inc., Osaka (JP)

(72) Inventor: Keisuke Egawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 107 days.

(21) Appl. No.: 18/387,189

(22) Filed: Nov. 6, 2023

(65) Prior Publication Data

US 2024/0158198 A1 May 16, 2024

(30) Foreign Application Priority Data

Nov. 15, 2022 (JP) ..... 2022-182829

(51) Int. Cl.
*B65H 29/24* (2006.01)
*B65H 29/14* (2006.01)
*B65H 31/02* (2006.01)

(52) U.S. Cl.
CPC ..... *B65H 29/245* (2013.01); *B65H 29/14* (2013.01); *B65H 29/246* (2013.01); *B65H 31/02* (2013.01); *B65H 2301/4461* (2013.01); *B65H 2405/11152* (2013.01); *B65H 2701/1311* (2013.01); *B65H 2701/1313* (2013.01); *B65H 2801/24* (2013.01); *B65H 2801/27* (2013.01)

(58) Field of Classification Search
CPC ..... B65H 2301/4461; B65H 29/246; B65H 29/245; B65H 29/247; B65H 29/248; B65H 2515/20
See application file for complete search history.

(56) References Cited

U.S. PATENT DOCUMENTS 9,914,611 B2 * 3/2018 Tokuma ..... B65H 29/246
2019/0367312 A1 12/2019 Kishimoto et al.

FOREIGN PATENT DOCUMENTS

JP 2011001197 A 1/2011
JP 2019206418 A 12/2019

* cited by examiner

*Primary Examiner* — Jeremy R Severson
(74) *Attorney, Agent, or Firm* — IP Business Solutions, LLC.

(57) ABSTRACT

A postprocessing device includes a processing tray, a sheet processor, an air blower, an inlet roller pair, and a drive controller. The air blower forms an air layer between an upper face of a first recording sheet already placed on a loading surface of the processing tray, and a lower face of a second recording sheet to be newly placed on the processing tray, by sending air along a transport direction of the recording sheet, from an upstream side in the transport direction toward the loading surface. The drive controller performs an air sending operation, by causing the air blower to send air along the transport direction, before a second recording sheet contacts the upper face of the first recording sheet, and stop sending air before a trailing edge of the second recording sheet in the transport direction passes a nip region defined by the inlet roller pair.

8 Claims, 7 Drawing Sheets

POST-PROCESSING DEVICE THAT CONTROLS TIMING THAT AIR BLOWER FORMS AIR LAYER BETWEEN UPPER FACE OF FIRST RECORDING SHEET AND LOWER FACE OF SECOND RECORDING SHEET, AND IMAGE FORMING SYSTEM

INCORPORATION BY REFERENCE

This application claims priority to Japanese Patent Application No. 2022-182829 filed on Nov. 15, 2022, the entire contents of which are incorporated by reference herein.

BACKGROUND

The present disclosure relates to a postprocessing device that performs postprocessing on a plurality of recording sheets, and an image forming system including such postprocessing device.

In many of existing image forming apparatuses, an image reading device reads the image of a source document, and an image forming device forms the image of the source document on a recording sheet. In addition, postprocessing devices are known that receive the recording sheet, having the image of the source document formed thereon, from the image forming apparatus, and perform postprocessing on the recording sheet. The postprocessing performed by the postprocessing device includes, for example, aligning of the edges of a plurality of recording sheets, a stapling operation including binding the aligned edges of the recording sheets, a punching operation for perforating the aligned edges of the recording sheets, and an inward folding operation for folding the aligned recording sheets.

The postprocessing device includes a processing tray for placing and temporarily retaining the recording sheets thereon, for the purpose of performing the postprocessing. The postprocessing device performs predetermined postprocessing, on the recording sheets retained on the processing tray. For example, a first postprocessing device is known that includes a tray for temporarily retaining following recording sheets (second intermediate storage section), located on the upper side of the processing tray (first intermediate storage section).

Further, a second postprocessing device is known that includes an air sending device for sending air to a space between the upper face of the first sheet, which is the uppermost one of the sheets accumulated on the sheet tray, and the lower face of the second sheet being delivered to the sheet tray via an inlet guide.

SUMMARY

The disclosure proposes further improvement of the foregoing techniques.

In an aspect, the disclosure provides a postprocessing device to be mounted on an image forming apparatus, to perform postprocessing on a recording sheet. The postprocessing device includes a processing tray, a sheet processor, an air blower, an inlet roller pair, and a drive controller. The processing tray receives and temporarily retains the recording sheet delivered from the image forming apparatus. The sheet processor performs predetermined postprocessing, on the recording sheet retained on the processing tray. The air blower forms an air layer between an upper face of a first recording sheet already placed on a loading surface of the processing tray, and a lower face of a second recording sheet to be newly placed on the processing tray, by sending air along a transport direction of the recording sheet, from an upstream side in the transport direction toward the loading surface. The inlet roller pair is located upstream of the processing tray in the transport direction, and delivers the recording sheet to the processing tray. The drive controller includes a processor, and controls an action of the air blower, when the processor executes a control program. The drive controller performs an air sending operation by controlling the action of the air blower, including causing the air blower to send air along the transport direction, before a second recording sheet contacts the upper face of the first recording sheet, and stop sending air before a trailing edge of the second recording sheet in the transport direction passes a nip region defined by the inlet roller pair.

In another aspect, the disclosure provides an image forming system including the foregoing postprocessing device, and an image forming apparatus. The image forming apparatus includes an image forming device and a transport roller. The image forming device forms an image on a recording sheet, and the transport roller transports the recording sheet on which the image has been formed, to the postprocessing device.

DETAILED DESCRIPTION

Figure 1:
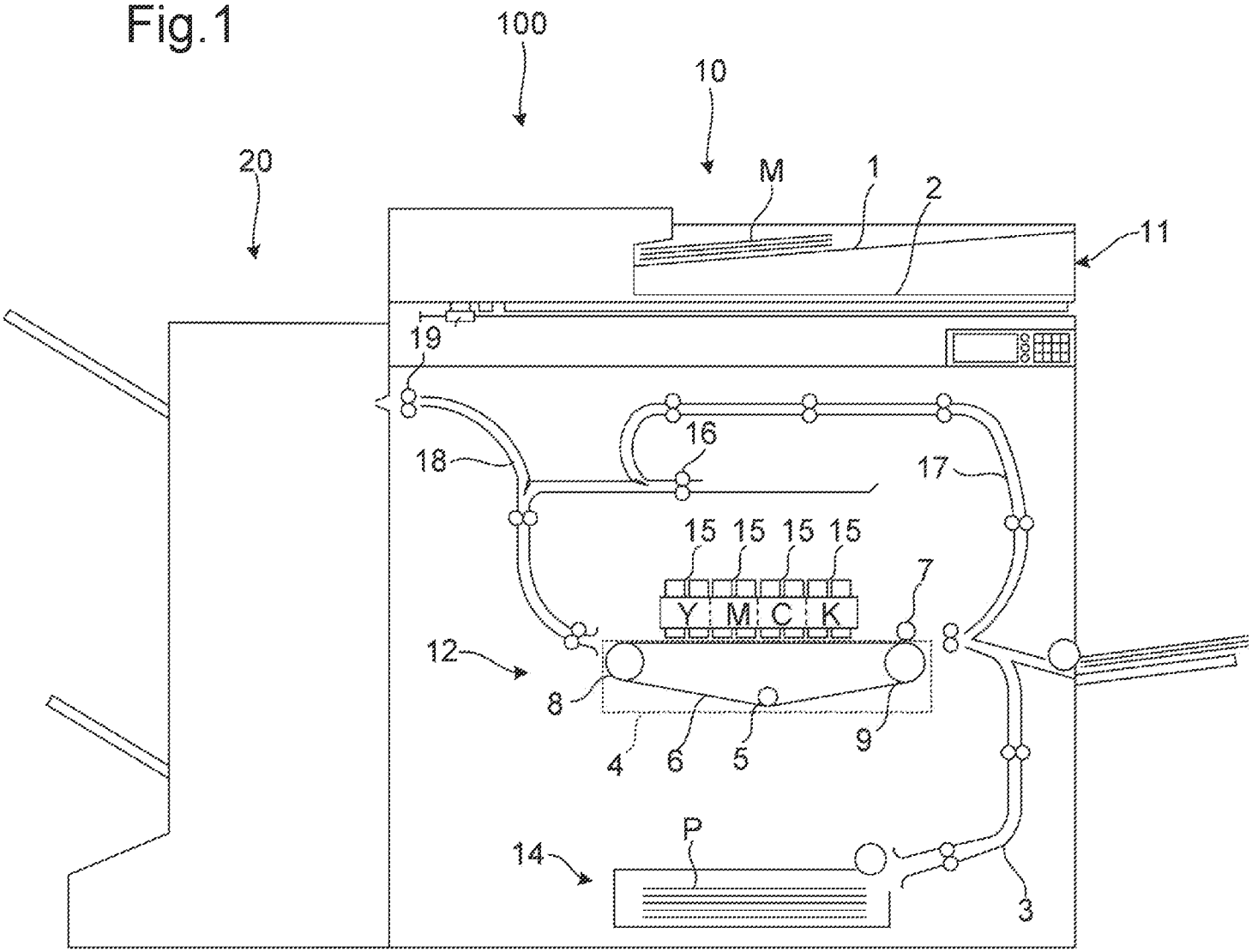
FIG. 1 is a partially cross-sectional front view showing an image forming system including a postprocessing device according to an embodiment of the disclosure.

Hereafter, a postprocessing device and an image forming system according to an embodiment of the disclosure will be described, with reference to the drawings. FIG. 1 is a partially cross-sectional front view of the image forming system 100, including the postprocessing device 20 according to the embodiment of the disclosure. As shown in FIG. 1, the image forming system 100 includes an image forming apparatus 10 that reads an image of a source document and forms the image on a recording sheet P, and the postprocessing device 20 that receives the recording sheet P from the image forming apparatus 10, and performs postprocessing on the recording sheet P.

The image forming apparatus 10 is a multifunction peripheral having a plurality of functions, such as copying, printing, scanning, and facsimile transmission. The image forming apparatus 10 includes an image reading device 11 and an image forming device 12. When a plurality of source documents M are placed on a document tray 1, the image reading device 11 sequentially draws out the source documents M from the document tray 1 one by one, reads the image of each of the source documents M with an image sensor, and sequentially delivers the source documents M to the discharge tray 2, so as to stack the source documents M on each other. The image reading device 11 converts the analog output from the image sensor to a digital signal, and generates image data representing the image of each of the source documents M.

The image forming device 12 forms the image of the source document M represented by the image data, on the recording sheet P through an ink jet process, each time the image data representing the image of each of the source documents M is inputted. The image forming device 12 includes line heads 15 that respectively eject ink of four colors, namely black, cyan, magenta, and yellow. The line heads 15 each eject the ink droplets of the corresponding color onto the recording sheet P, delivered to a conveying unit 4 from a paper feeding device 14 through a first transport route 3, thereby forming a color image on the recording sheet P.

The conveying unit 4 includes a drive roller 8, a follower roller 9, tension roller 5, and a transport belt 6. The transport belt 6 is an endless belt stretched around the drive roller 8, the follower roller 9, and the tension roller 5. The drive roller 8 is driven by a motor so as to rotate counterclockwise in FIG. 1. When the drive roller 8 is made to rotate, the transport belt 6 revolves counterclockwise in FIG. 1, and the follower roller 9 and the tension roller 5 are each passively made to rotate counterclockwise in FIG. 1, by the transport belt 6.

The tension roller 5 serves to maintain the tension of the transport belt 6 at an appropriate level. The transport belt 6 is in contact with an adsorption roller 7. The adsorption roller 7 electrically charges the transport belt 6, to thereby electrostatically adsorb the recording sheet P delivered from the paper feeding device 14, to the transport belt 6.

When the images of the documents M are formed on the respective recording sheets P by the image forming device 12, the recording sheets P are transported to the postprocessing device 20, through a relay transport route 18 and a transport roller 19. In this case, the recording sheet P is transported with the face having the image of the source document M formed thereon oriented upward, in other words in a face-up orientation, to the postprocessing device 20.

When the recording sheet P is to be delivered to the postprocessing device 20 with the face having the image of the source document M formed thereon oriented downward, in other words in a face-down orientation, a switchback transport is performed including transporting the recording sheet P from the relay transport route 18 to the transport roller 16, once stopping the transport roller 16 and then reversely rotating the same. Accordingly, the recording sheet P is returned to the conveying unit 4 through a second transport route 17, thereby inverting the front and back faces of the recording sheet P. The recording sheet P, the front and back faces of which have been inverted as above, is transported to the postprocessing device 20, through the relay transport route 18 and the delivery roller 19.

When the image of the source document M is also to be formed on the back face of the recording sheet P, the recording sheet P is returned, after the switchback transport is performed, to the conveying unit 4 through the second transport route 17, in the inverted orientation. Then the image forming device 12 forms the image of the source document M on the back face of the recording sheet P, the front and back faces of which have been inverted. The recording sheet P having the image formed on the back face thereof is transported to the postprocessing device 20, through the relay transport route 18 and the delivery roller 19. The transport of the recording sheet P, and the image forming operation are controlled by a controller 66 (see FIG. 4) to be subsequently described.

Figure 2:
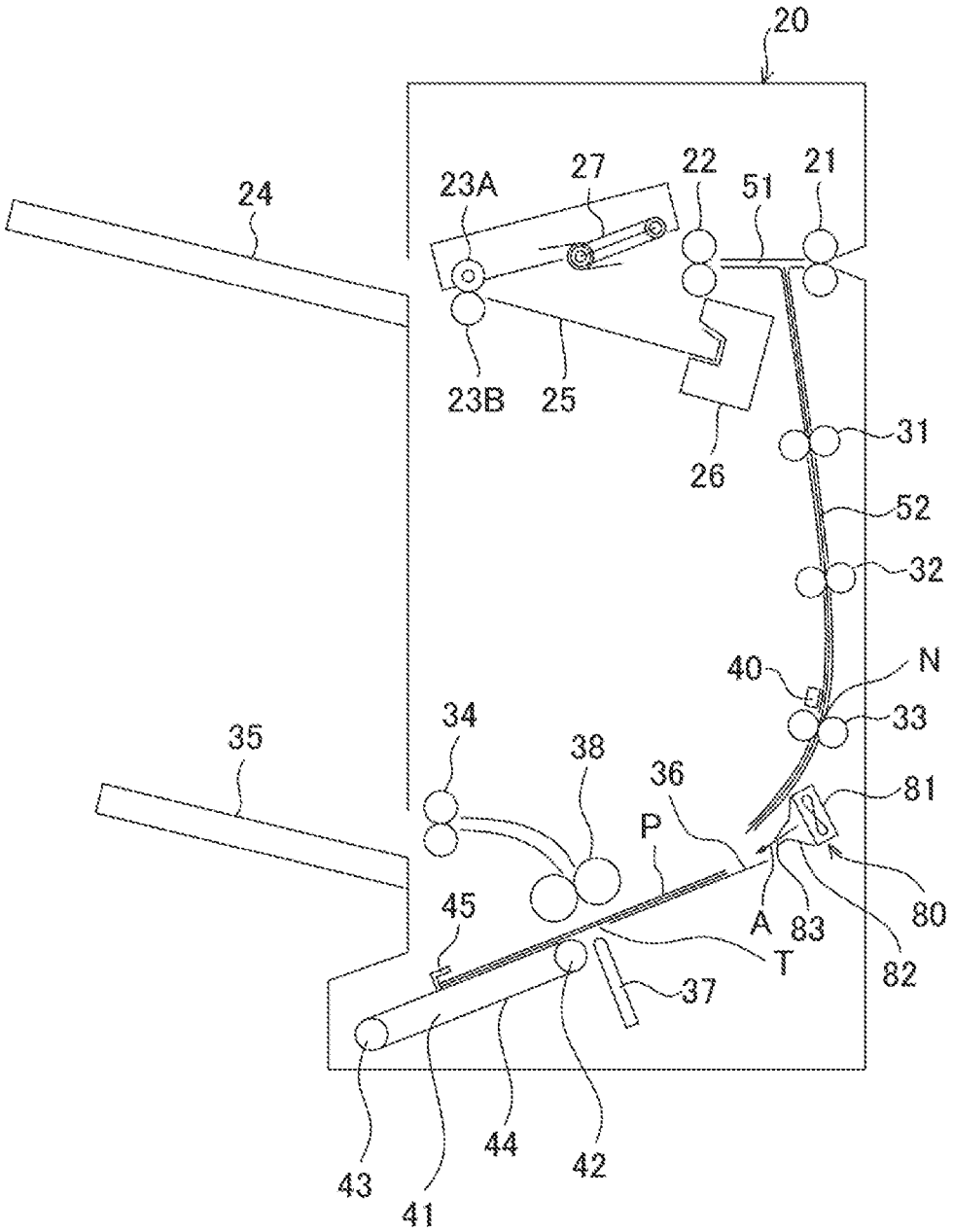
FIG. 2 is an enlarged cross-sectional front view of the postprocessing device.

FIG. 2 is an enlarged, partially cross-sectional front view of the postprocessing device 20. As shown in FIG. 2, the postprocessing device 20 includes, in the upper area thereof, two transport roller pairs 21 and 22, a pair of delivery rollers 23A and 23B, an output tray 24, a processing tray 25 for placing and temporarily retaining thereon the recording sheets P, a stapling device 26, and a paddle 27. The postprocessing device 20 includes, in the middle area thereof, two transport roller pairs 31 and 32.

The postprocessing device 20 includes, in the lower area thereof, an inlet roller pair 33, a delivery roller pair 34, an output tray 35, a processing tray 36 for placing and temporarily retaining thereon the recording sheets P, a blade 37, a folding roller pair 38, an air blower 80, and a sheet sensor 40. The blade 37 and the folding roller pair 38 exemplify the sheet processor in the disclosure. The blade 37 and the folding roller pair 38 serve to inwardly fold the recording sheet P placed on the processing tray 36.

Figure 4:
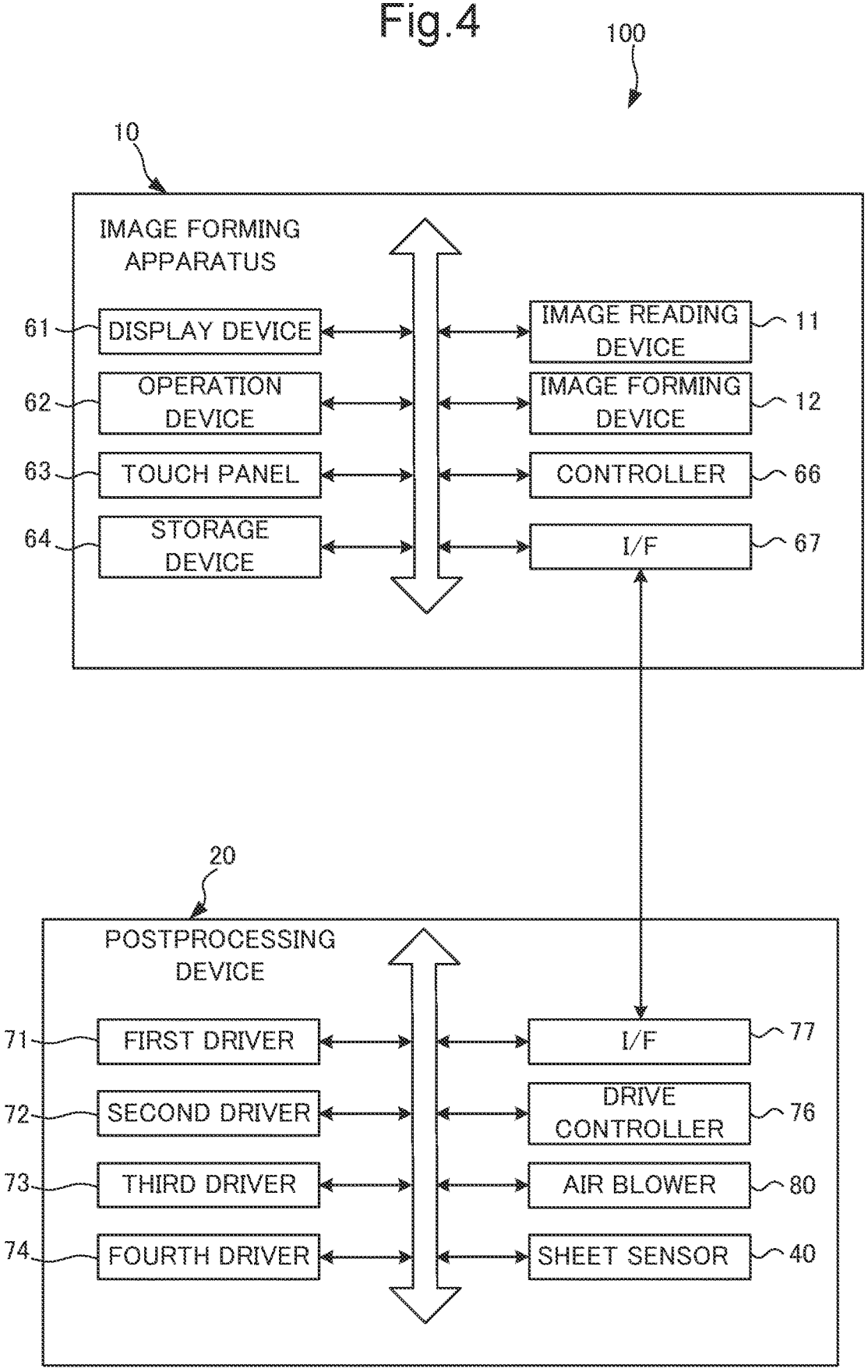
FIG. 4 is a functional block diagram schematically showing an essential internal configuration of the image forming apparatus and the postprocessing device.

The blade 37 is driven by a first driver 71 shown in FIG. 4, for example constituted of a motor, so as to vertically reciprocate with respect to the recording sheet P placed on the processing tray 36. The processing tray 36 includes a belt moving mechanism 41 for moving the recording sheet P placed on the processing tray 36. In the processing tray 36, a clearance T is formed for the blade 37 pass through.

The belt moving mechanism 41 includes a drive roller 42, a follower roller 43, a moving belt 44, and a bent piece 45 provided on the outer circumferential surface of the moving belt 44. The moving belt 44 is an endless belt stretched around the drive roller 42 and the follower roller 43. The drive roller 42 is driven by a motor so as to rotate. When the drive roller 42 is made to rotate, the moving belt 44 revolves. The drive roller 42 is driven by a second driver 72 shown in FIG. 4, for example constituted of a motor, so as to rotate clockwise or counterclockwise. The belt moving mechanism 41 and the processing tray 36 are oriented such that the downstream side of the recording sheet P in the transport direction is inclined downward.

The moving belt 44 pushes up the recording sheet P placed on the processing tray 36 to the upstream side in the transport direction, by revolving clockwise in FIG. 2. The moving belt 44 pulls back the recording sheet P placed on the processing tray 36 to the downstream side in the transport direction, by revolving counterclockwise in FIG. 2. The bent piece 45 is bent toward the upstream side in the transport direction, to prevent the leading edge of the recording sheet P placed on the processing tray 36 from falling off.

At the branch point between the transport roller pair 21 and the transport roller pairs 22 and 31, a flap to be made to swing, by a driver such as a motor, is provided. The postprocessing device 20 causes the flap to swing, so as to deliver the recording sheet P transported from the image forming apparatus 10, either to the output tray 24 on the left in FIG. 2, through a third transport route 51, or to the output tray 35, on the lower side in FIG. 2, through a fourth transport route 52.

The air blower 80 includes a fan 81, and a duct 82 that guides the air emitted from the fan 81 to a loading surface of the processing tray 36. The air blower 80 emits air from an air outlet 83 of the duct 82 in the direction of an arrow A, so that the air flows from the upstream side of the recording sheet P in the transport direction toward the loading surface of the processing tray 36. In other words, the air blower 80 emits air from an upper position upstream of the recording sheet P in the transport direction, toward a lower position on the downstream side in the transport direction, along the upper face of the belt moving mechanism 41 and the processing tray 36.

The duct 82 and the air outlet 83 of the air blower 80 are located so as to extend in the width direction of the recording sheet P to be placed on the loading surface of the processing tray 36. The fan 81 is capable of supplying air to the entire region of the duct 82 and the air outlet 83 extending in the width direction. For example, a single fan 81 may be installed to emit air to the entire region of the duct 82 and the air outlet 83 in the width direction, or a plurality of fans 81 aligned in the width direction may emit air to the entire region in the width direction.

With the mentioned configuration, when one or more recording sheets P are already placed on the loading surface of the processing tray 36, the air emitted from the air blower 80 forms an air layer between the upper face of the recording sheet P and the lower face of the recording sheet P to be newly placed on the processing tray 36. The air outlet 83 of the air blower 80 is located at the height that allows the air blower 80 to emit air so as not to directly hit the trailing edge of the recording sheet P placed on the loading surface.

The duct 82 is located at the position that allows the air from the fan 81 to be emitted through the air outlet 83, parallel to the loading surface of the processing tray 36, or from an upper side of the loading surface. In other words, the air sending direction A of the fan 81 is either parallel to the loading surface of the processing tray 36, or obliquely downward onto the loading surface from the upper side. Setting thus the air sending direction A of the fan 81 prevents the air from the fan 81 from lifting up the recording sheet P on the processing tray 36, thereby suppressing disturbance against the loading action of the recording sheet P on the processing tray 36. FIG. 2 illustrates the example where the air sending direction A of the fan 81 is set such that the air flows obliquely downward onto the loading surface of the processing tray 36, from the upper side.

The sheet sensor 40 detects the leading edge and the trailing edge of the recording sheet P entering into the inlet roller pair 33. The sheet sensor 40 is, for example, an optical reflective sensor having a light emitting element that emits light toward the recording sheet P, and a photodetector that receives the light reflected by the recording sheet P.

[When Delivering Recording Sheet P to Output Tray 24 on Upper Side]

The drive controller 76 (see FIG. 4) of the postprocessing device 20 transports the recording sheet P delivered from the image forming apparatus 10 through the third transport route 51 using the two transport roller pairs 21 and 22, and then delivers the recording sheet P to the output tray 24, through the delivery rollers 23A and 23B. Alternatively, the drive controller 76 (see FIG. 4) of the postprocessing device 20 can cause the stapling device 26 to bind the end portions of the plurality of recording sheets P, delivered from the image forming apparatus 10 and stacked on the processing tray 25, and deliver the sheaf of the recording sheets P bound as above, from the processing tray 25 to the output tray 24, through the delivery rollers 23A and 23B.

[When Delivering Recording Sheet P to Output Tray 35 on Lower Side]

The drive controller 76 of the postprocessing device 20 transports the recording sheet P delivered from the image forming apparatus 10 through the fourth transport route 52, using the two transport roller pairs 31 and 32 and the inlet roller pair 33, and the processing tray 36 receives the recording sheet P discharged from the fourth transport route 52.

Figure 3A:
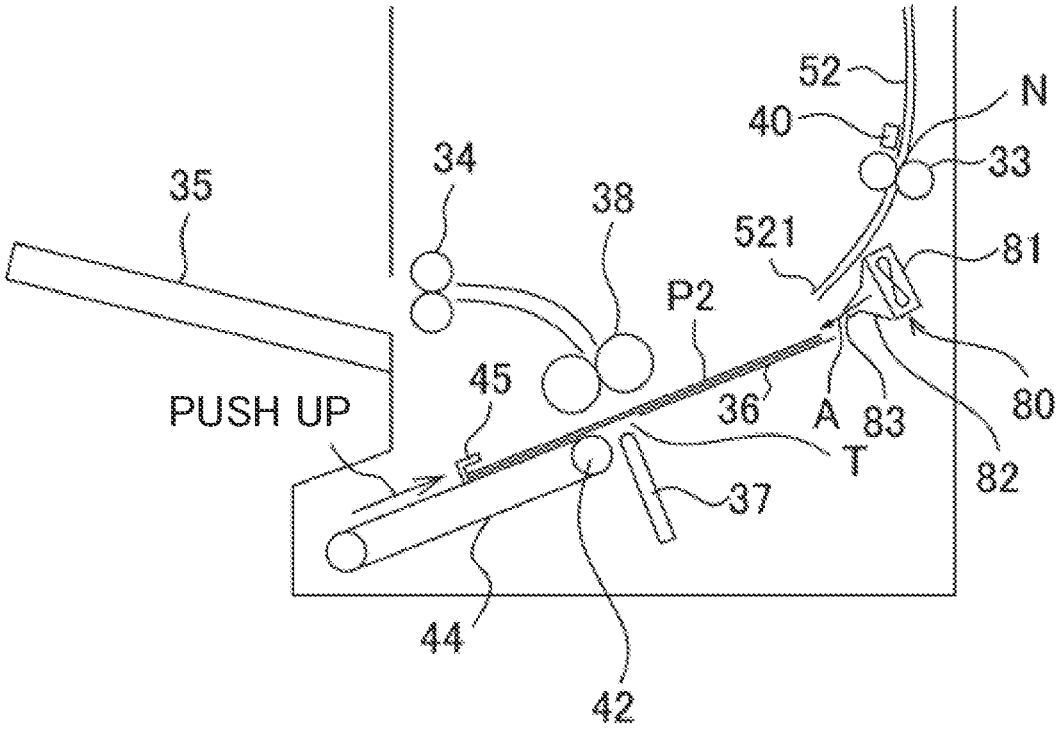
FIG. 3A and FIG. 3B are cross-sectional views for explaining the action taken when a following recording sheet is delivered to a processing tray located on the lower portion of the device.

Then the drive controller 76 of the postprocessing device 20 causes the moving belt 44 to revolve clockwise as shown in FIG. 3A, thereby pushing up the recording sheet P2 placed on the processing tray 36 to the upstream side in the transport direction, to a predetermined position. The predetermined position is defined such that the leading edge of the recording sheet P1 discharged from the fourth transport route 52 can be kept from contacting the trailing edge of the recording sheet P2 placed on the processing tray 36, and that the air emitted from the air blower 80 does not directly hit the trailing edge of the recording sheet P2.

The position to which the air is emitted from the air blower 80 is defined such that the air does not directly hit the trailing edge of the recording sheet P2 which has reached the predetermined position, for example on the upper side of the uppermost one of the maximum number of recording sheets P that the processing tray 36 can accept, and on the downstream side of the trailing edge of the recording sheet P2, in the transport direction.

It is for the purpose of preventing the leading edge of the recording sheet P1 from being caught by the trailing edge of the recording sheet P2 and disabled from proceeding further, or preventing the trailing edge of the recording sheet P2 from being lifted up, that the recording sheet P placed on the processing tray 36 is moved to the position where the trailing edge of the recording sheet P2 is kept from contacting the leading edge of the recording sheet P1 discharged from the fourth transport route 52.

Figure 3B:
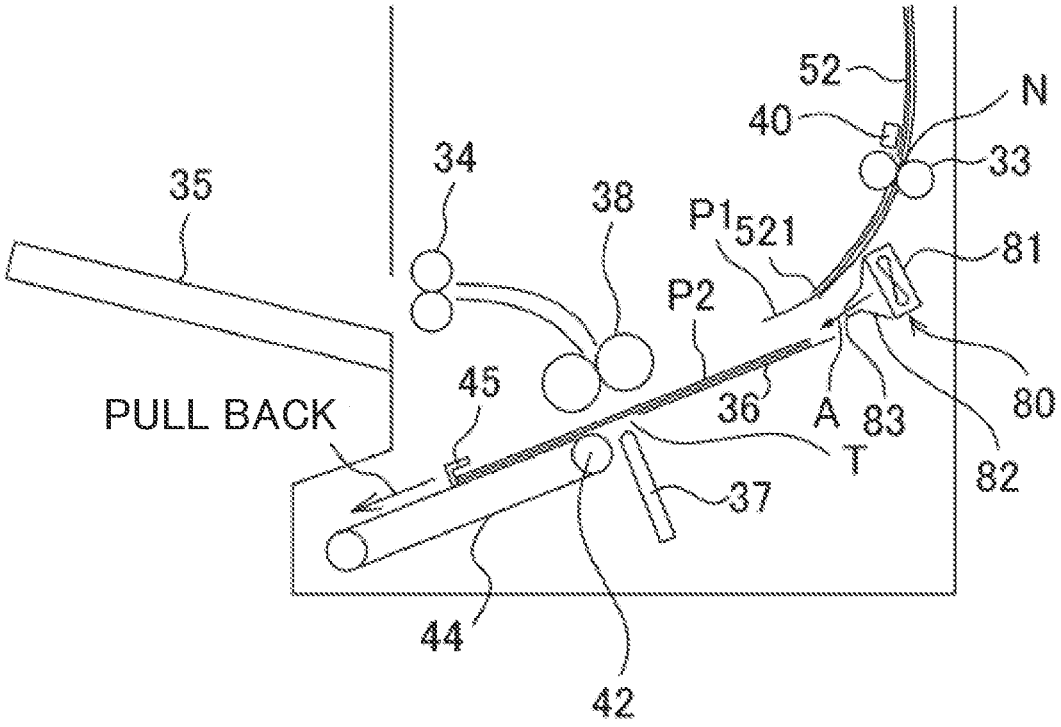

When an additional recording sheet P1 is discharged from the fourth transport route 52 and placed on the processing tray 36, the drive controller 76 causes the moving belt 44 to revolve counterclockwise as shown in FIG. 3B, thereby gradually pulling back the recording sheet P2 placed on the processing tray 36 toward the downstream side in the transport direction, to the position shown in FIG. 2.

The drive controller 76 of the postprocessing device 20 moves the sheaf of the recording sheets P placed on the processing tray 36 using the moving belt 44, so as to bring the position to be folded in the sheaf of the recording sheets P to the clearance T. Then the drive controller 76 moves the blade 37, so that the blade 37 pushes up the sheaf of the recording sheets P, into a mountain fold shape. Further, the drive controller 76 of the postprocessing device 20 causes the folding roller pair 38 to catch the mountain fold shape portion of the sheaf of the recording sheets P, and to transport the sheaf of the recording sheets P in the folded state, so that the folded sheaf of the recording sheets P is delivered to the output tray 35, from the processing tray 36 through the delivery roller 34.

Hereunder, a configuration related to the control operation of the image forming apparatus 10 and the postprocessing device 20 will be described. FIG. 4 is a functional block diagram schematically showing an essential internal configuration of the image forming apparatus 10 and the postprocessing device 20, constituting the image forming system 100. As shown in FIG. 4, the image forming apparatus 10 includes the image reading device 11, the image forming device 12, a display device 61, an operation device 62, a touch panel 63, a storage device 64, the controller 66, and an interface (hereinafter, I/F) 67. The mentioned components are configured to transmit and receive data and signals to and from each other, via a bus.

The display device 61 is, for example, constituted of a liquid crystal display (LCD) or an organic light-emitting diode (OLED) display.

The operation device 62 includes physical keys such as a tenkey, an enter key, and a start key. The operation device 62 receives inputs of various instructions, corresponding to the user's operation performed on the mentioned keys.

A touch panel 63 is overlaid on the screen of the display device 61. The touch panel 63 is based on a resistive film or electrostatic capacitance. The touch panel 63 detects a contact (touch) of the user's finger made thereon, along with the touched position, and outputs a detection signal indicating the coordinate of the touched position, to the control device 66.

The storage device 64 is a large-capacity storage device such as a solid-state drive (SSD) or a hard disk drive (HDD). The storage device 64 contains various application programs and various types of data.

The controller 66 includes a processor, a random-access memory (RAM), a read-only memory (ROM), and so forth. The processor is, for example, a central processing unit (CPU), an application specific integrated circuit (ASIC), or a micro processing unit (MPU). The controller 66 acts as a processing device that executes the control program stored in the ROM or the storage device 64, thereby executing various processings necessary for the image forming job by the image forming apparatus 10.

The controller 66 is connected to the image reading device 11, the image forming device 12, the display device 61, the operation device 62, the touch panel 63, the storage device 64, and the I/F 67. The controller 66 controls the operation of the components cited above, and transmits and receives signals and data to and from those components.

The controller 66 controls the displaying operation of the display device 61. The controller 66 receives the instruction inputted by the user, on the basis of the detection signal outputted from the touch panel 63 or a press of the physical key on the operation device 62. For example, the controller 66 receives the instruction according to a touch operation, performed through the touch panel 63 on the graphical user interface (GUI) displayed on the screen of the display device 61.

The postprocessing device 20 includes the air blower 80, the sheet sensor 40, the first driver 71 to a fourth driver 74, the drive controller 76, and an I/F 77. These components are configured to transmit and receive data and signals to and from each other, via a bus.

The drive controller 76 includes a processor, a RAM, a ROM, and so forth. The processor is, for example, a CPU, an ASIC, or an MPU. The drive controller 76 serves as a processing device that executes the drive control program stored in the ROM, thereby executing various operations necessary for the postprocessing by the postprocessing device 20.

The controller 66 of the image forming apparatus 10 and the drive controller 76 of the postprocessing device 20 are configured to input and output data and signals between each other, via the respective I/Fs 67 and 77. For example, the controller 66 of the image forming apparatus 10 outputs a control signal for instructing the postprocessing device 20 to perform the postprocessing, to the drive controller 76 of the postprocessing device 20. The drive controller 76 of the postprocessing device 20 controls the air blower 80, the first driver 71, and the second driver 72, according to the control signal received.

The first driver 71 and the second driver 72 of the postprocessing device 20 each include, for example, a stepping motor serving as the drive source. As already described, for example the first driver 71 includes the drive source for moving the blade 37. Likewise, the second driver 72 includes the drive source for rotating the drive roller 42.

The drive controller 76 controls the action of the motor of the first driver 71, thereby causing the blade 37 to vertically reciprocate, with respect to the recording sheet P placed on the processing tray 36. The drive controller 76 controls the action of the motor of the second driver 72, so as to cause the drive roller 42 to rotate clockwise or counterclockwise. By thus causing the moving belt 44 to revolve, the drive controller 76 causes the processing tray 36 to push up the recording sheet P2 placed thereon to the upstream side in the transport direction, and move the recording sheet P2 to the downstream side in the transport direction.

The drive controller 76 performs an air sending operation by controlling the action of the air blower 80, including sending air from the air blower 80 along the transport direction, before the recording sheet P1 to be newly placed on the processing tray 36 contacts the upper face of the recording sheet P2 already placed on the loading surface of the processing tray 36, and stop sending air from the air blower 80 before the trailing edge of the recording sheet P1 to be newly placed passes (comes out from) a nip region N defined by the inlet roller pair 33.

Figure 5:
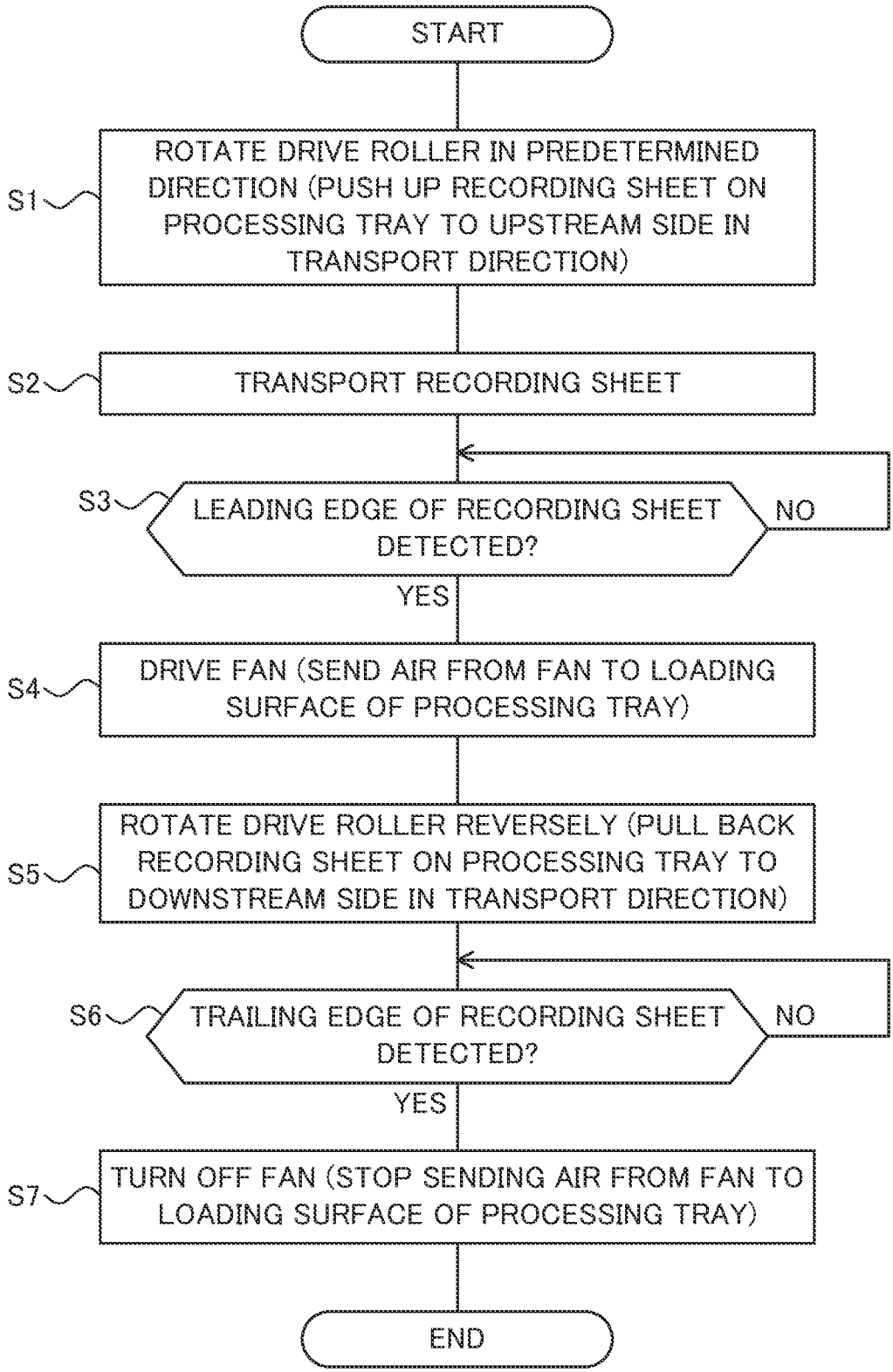
FIG. 5 is a flowchart showing a process of an air sending operation.

Referring now to a flowchart shown in FIG. 5, the air sending operation performed by the drive controller 76 of the postprocessing device 20 will be described hereunder.

Upon receipt of an instruction to execute the inward folding operation, according to the user's operation performed on the start key of the operation device 62, the controller 66 of the image forming apparatus 10 outputs a control signal indicating the instruction to execute the inward folding operation, to the postprocessing device 20 through the I/F 67.

Upon receipt of the control signal indicating the instruction to execute the inward folding operation, through the I/F 77, the drive controller 76 of the postprocessing device 20 controls the second driver 72 so as to cause the drive roller 42 to rotate clockwise in FIG. 3A (step S1). Thus, the drive controller 76 causes the moving belt 44 to revolve clockwise, thereby moving the recording sheet P2 placed on the processing tray 36 to a receiving position on the upstream side in the transport direction, as shown in FIG. 3A. Here, since no recording sheet P is placed on the processing tray 36, when the first recording sheet P is transported, the operation of step S1 may be started when the second recording sheet P is about to be transported.

The drive controller 76 controls the drive source of the transport roller pairs 31 and 32 and the inlet roller pair 33, so as to transport the recording sheet P delivered next from the image forming apparatus 10, toward the belt moving mechanism 41 and the processing tray 36, along the fourth transport route 52 (step S2). Upon deciding, on the basis of the detection output from the sheet sensor 40, that the leading edge of the recording sheet P1 being transported along the fourth transport route 52 has passed the position corresponding to the sheet sensor 40 (YES at step S3), the drive controller 76 turns on the fan 81, by controlling the action of the fan 81 of the air blower 80 (step S4).

Thus, the drive controller 76 sends air from the fan 81 toward the loading surface of the processing tray 36. The drive controller 76 then controls the second driver 72, so as to cause the drive roller 42 to rotate counterclockwise in FIG. 3B (step S5). As result, the moving belt 44 is made to revolve counterclockwise, so that the recording sheet P2 placed on the processing tray 36 is moved to a standby position, on the downstream side in the transport direction.

After step S5, upon deciding, on the basis of the detection output from the sheet sensor 40, that the trailing edge of the recording sheet P1 being transported along the fourth transport route 52 has passed the position corresponding to the sheet sensor 40 (YES at step S6), the drive controller 76 turns off the fan 81, by controlling the action of the fan 81 of the air blower 80 (step S7). As result, the drive controller 76 restricts the air from the fan 81 from being emitted toward the loading surface of the processing tray 36.

The drive controller 76 repeats the operation of step S1 to step S7, until a prespecified number of recording sheets P are placed on the processing tray 36. When the prespecified number of recording sheets P are placed on the processing tray 36, the drive controller 76 controls the moving belt 44, the blade 37, and the folding roller 38 by a known control method, so as to inwardly fold the sheaf of the recording sheet P, and deliver the folded sheaf of the recording sheets P to the output tray 35.

During the mentioned process, the air layer is formed with the air emitted from the fan 81, between the upper face of the recording sheet P already placed on the loading surface of the processing tray 36, and the lower face of the recording sheet P newly placed on the processing tray 36.

Now, a plurality of recording sheets P are placed on the processing tray 36. Accordingly, the upper face of the recording sheet P2 already placed on the processing tray 36, and the lower face of the recording sheet P1 being newly placed enter into contact with each other, during the transport operation of the recording sheets P. Such a contact may impede the recording sheet P from proceeding further, or cause the recording sheet P to bounce, because of the friction between the recording sheets P, which may lead to failure in properly placing the recording sheets P on the processing tray 36. In particular, when the recording sheets P subjected to the ink jet printing operation are transported, such recording sheets P are often transported in a wet state, with the ink undried yet, and therefore the frictional force between the recording sheets P is increased.

Although the technique employed in the aforementioned first postprocessing device can reduce the friction arising from the contact between the recording sheets P, it takes a longer time before the recording sheet P is placed on the processing tray 36, and therefore the productivity is lowered.

With the aforementioned second postprocessing device, the air layer can be formed between the lower face of the second sheet, being delivered to the processing tray through the inlet guide, and the upper face of the uppermost first sheet already placed on the processing tray 36. Therefore, the second sheet can be prevented from closely contacting the uppermost first sheet. On the other hand, the presence of the air layer may make it difficult for the second sheet to properly land on the uppermost first sheet, and the recording sheets on the processing tray may fail to be accurately aligned with each other.

Without such air layer, for example, when the leading edge of the recording sheet P1 delivered through the inlet roller pair 33 to be newly placed on the processing tray 36 makes contact with the upper face of the recording sheet P2 already placed on the processing tray 36, the recording sheet P1 is bent in the region between the leading edge thereof and the exit 521 of the fourth transport route 52, owing to the resistance arising from the contact, and the pressure from the transport of the recording sheet P. Then the upper face of the recording sheet P2 is biased to the downstream side in the transport direction, by the leading edge of the recording sheet P1, owing to the restoring force (stiffness) of the recording sheet P1 to recover from the bent state. As result, the stacking status of the sheaf of the recording sheets P2 may become irregular, or the recording sheet P1 may fail to be properly placed on the sheaf of the recording sheets P2.

However, according to the foregoing embodiment, the air layer is formed with the air emitted from the air blower 80 (fan 81), as described above. Accordingly, the resistance arising from the contact between the leading edge of the recording sheet P1, delivered through the inlet roller pair 33 to be newly placed on the processing tray 36, and the upper face of the recording sheet P2 already placed on the processing tray 36 can be reduced, and therefore the extent of the bending of the recording sheet P1, to be newly placed on the processing tray 36 can be mitigated. Therefore, the recording sheet P1 can be placed on the recording sheet P2, with a reduced biasing force from the leading edge of the recording sheet P1, biasing the upper face of the recording sheet P2 toward the downstream side in the transport direction. Further, the air layer urges the drying of the recording sheet P.

The air layer may incur disturbance against the loading action of the recording sheet P on the processing tray 36. With the configuration according to the foregoing embodiment, however, the fan 81 is turned off when the trailing edge of the recording sheet P1 being transported along the fourth transport route 52 passes the position corresponding to the sheet sensor 40. In other words, the air is emitted from the air blower 80, only until the trailing edge of the recording sheet P to be newly placed on the processing tray 36 comes out from the nip region N between the inlet roller pair 33. Accordingly, the trailing edge of the recording sheet P to be newly placed can be exempted from being disturbed by the air layer, from smoothly landing on the processing tray 36 or the upper face of the recording sheet P already placed thereon. Thus, the disturbance by the air layer, against the loading action of the recording sheet P on the processing tray 36, can be prevented.

Although the fan 81 is turned off, the fan 81 does not immediately stop rotating, but keeps rotating for a while because of inertia. On the assumption that, for example, the fan 81 stops rotating when a time T has elapsed after being turned off, the fan 81 has to be turned off, the time T (time before the fan 81 stops rotating after being turned off) earlier than the time that the trailing edge of the recording sheet P1 to be newly placed passes the nip region N between the inlet roller pair 33, in order to surely stop the rotation of the fan 81, by the time that the trailing edge of the recording sheet P1 passes the nip region N. For such purpose, as a second embodiment, the sheet sensor 40 may be located at the position from which it takes the time T for the recording sheet P to reach the nip region N.

According to the foregoing embodiment, the fan 81 is turned on when the leading edge of the recording sheet P1 being transported along the fourth transport route 52 passes the position corresponding to the sheet sensor 40. In other words, the air starts to be emitted from the air blower 80, before the recording sheet P1 to be newly placed on the processing tray 36 contacts the upper face of the recording sheet P2 already placed on the loading surface of the processing tray 36, and therefore these recording sheets P can be effectively prevented from contacting each other. As result, the recording sheets P can be stacked on the processing tray 36 in a regularly aligned state, and degradation in productivity can be suppressed.

Figure 6:
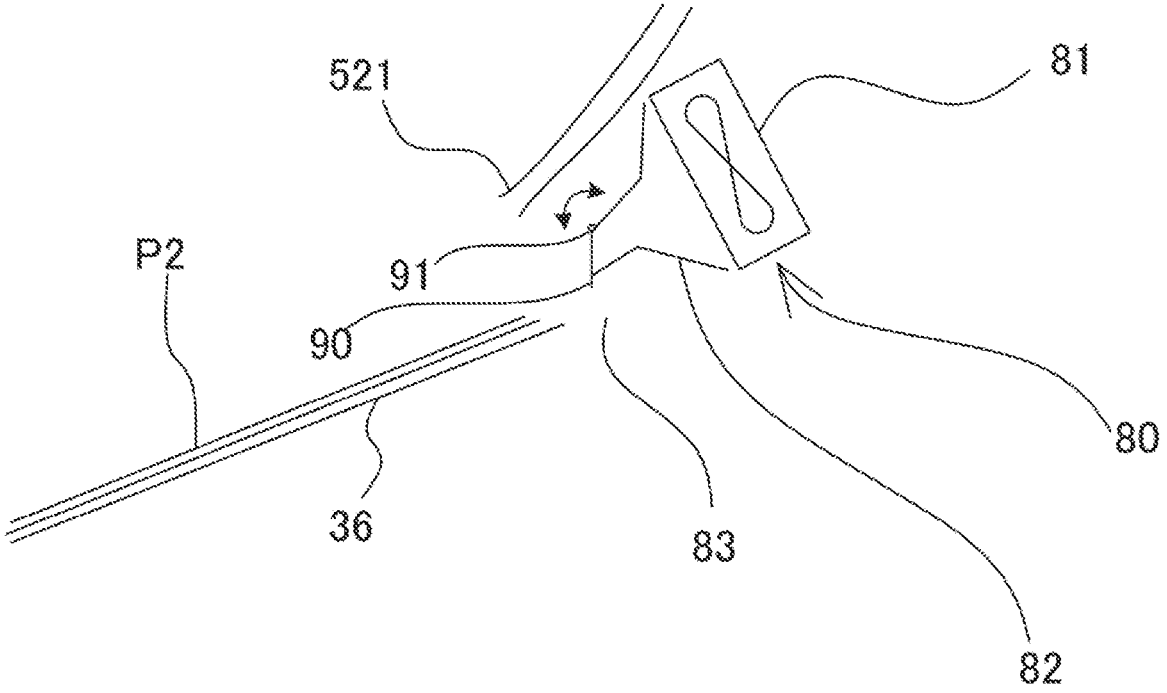
FIG. 6 is an enlarged cross-sectional front view showing an air blower and related components in a postprocessing device according to a third embodiment.

According to the foregoing embodiment, the sending of the air from the air blower 80 is controlled by turning on and off the fan 81. Alternatively, as a third embodiment, the air blower 80 may include a shutter 90, configured to open and close the air outlet 83 of the duct 82, as shown in FIG. 6. In this case, the drive controller 76 controls the opening and closing actions of the shutter 90, so as start and stop the sending of the air from the air blower 80. The shutter 90 may include a motor, so as to rotate with the rotative force supplied by the motor, about a rotation axis 91 in the direction indicated by an arrow shown in FIG. 6, thereby performing the opening and closing actions.

For example, upon deciding, on the basis of the detection output from the sheet sensor 40, that the leading edge of the recording sheet P1 being transported along the fourth transport route 52 has passed the position corresponding to the sheet sensor 40 (YES at step S3), the drive controller 76 turns on the fan 81, by controlling the action of the fan 81 of the air blower 80 (step S4), and causes the motor to rotate in a predetermined direction, so as to open the shutter 90.

Upon deciding, on the basis of the detection output from the sheet sensor 40, that the trailing edge of the recording sheet P1 being transported along the fourth transport route 52 has passed the position corresponding to the sheet sensor 40 (YES at step S6), the drive controller 76 turns off the fan 81, by controlling the action of the fan 81 of the air blower 80 (step S7), and causes the motor to rotate reversely to the predetermined direction, so as to close the shutter 90. In the case of the third embodiment including the shutter 90, there is no need to locate the sheet sensor 40 at the position from which it takes the time T for the recording sheet P to reach the nip region N.

Further, as a fourth embodiment, the drive controller 76 may identify the printing method of the image forming apparatus 10, to perform the air sending operation when the printing method is ink jet printing, but to keep from performing the air sending operation, when the printing method is electrophotography.

Still further, as a fifth embodiment, the drive controller 76 may receive, via the I/F 67 and 77, the instruction to turn on or off the air sending operation of the air blower 80, inputted by the user through the operation device 62 of the image forming apparatus 10, to perform the air sending operation when the instruction indicates "on", but to keep from performing the air sending operation, when the instruction indicates "off". Such an arrangement enables the user to optionally decide whether to cause the postprocessing device 20 to perform the air sending operation.

When the image is formed on the recording sheet P by electrophotography, using a developing agent such as a toner, the recording sheet P becomes less wet, compared with the case of the ink jet printing, and therefore the rigidity of the recording sheet P is barely lowered. In the fifth embodiment, the drive controller 76 keeps from activating the air blower 80, when a signal indicating that the printing method is the electrophotography is received from the image forming apparatus 10, but may activate the air blower 80, when a signal indicating that the printing method is the ink jet printing is received from the image forming apparatus 10.

For example, when the postprocessing device 20 is connected to the image forming apparatus 10, the controller 66 of the image forming apparatus 10 transmits, via the I/F 67, a signal indicating which of the ink jet printing and electrophotography is employed by the image forming apparatus 10, to the postprocessing device 20. Upon receipt of such signal via the I/F 77, the drive controller 76 of the postprocessing device 20 performs the air sending operation when the signal indicates the ink jet printing, but keeps from performing the air sending operation, when the signal indicates the electrophotography.

In a sixth embodiment, when the user inputs an instruction to cancel the function of the air blower 80, through the operation device 62, the controller 66 of the image forming apparatus 10 transmits a signal indicating such instruction, to the postprocessing device 20. The drive controller 76 of the postprocessing device 20 keeps from performing the air sending operation, when such instruction is received.

The disclosure may be modified in various manners, without limitation to the configuration according to the foregoing embodiments. For example, although the recording sheets P are accumulated on the processing tray 36 for performing the inward folding operation in the embodiments, the disclosure may be applied to the case where the recording sheets P are accumulated on a processing tray for performing a different postprocessing, such as the stapling operation. Although the air sending operation is performed by the air blower 80 on the recording sheet P2 placed on the processing tray 36, in the foregoing embodiments, the disclosure is not limited to such embodiments. For example, a configuration in which an air sending device, similar to the air blower 80, is provided on the upstream side of the processing tray 25 of the postprocessing device 20, in the transport direction of the recording sheet, so that the drive controller 76 controls the action of such air sending device, thereby performing an operation similar to FIG. 5, is also encompassed in the disclosure, as another embodiment.

The configurations and processings described in the foregoing embodiment and variations with reference to FIG. 1 to FIG. 6 are merely exemplary, and in no way intended to limit the disclosure to those configurations and processings.

While the present disclosure has been described in detail with reference to the embodiments thereof, it would be apparent to those skilled in the art the various changes and modifications may be made therein within the scope defined by the appended claims.

What is claimed is:

1. A postprocessing device to be mounted on an image forming apparatus to perform postprocessing on a recording sheet, the postprocessing device comprising:

a processing tray that receives and temporarily retains the recording sheet delivered from the image forming apparatus;

a sheet processor that performs predetermined postprocessing, on the recording sheet retained on the processing tray;

an air blower that forms an air layer between an upper face of a first recording sheet already placed on a loading surface of the processing tray, and a lower face of a second recording sheet to be newly placed on the processing tray, by sending air along a transport direction of the recording sheet, from an upstream side in the transport direction toward the loading surface;

an inlet roller pair located upstream of the processing tray in the transport direction, and configured to deliver the recording sheet to the processing tray; and a drive controller including a processor, and configured to control an action of the air blower, when the processor executes a control program, wherein the drive controller performs an air sending operation by controlling the action of the air blower, including causing the air blower to send air along the transport direction, before a second recording sheet contacts the upper face of the first recording sheet, and stop sending air before a trailing edge of the second recording sheet in the transport direction passes a nip region defined by the inlet roller pair.

2. The postprocessing device according to claim 1, wherein the air blower includes a fan, a duct that guides air emitted from the fan to the loading surface, and a shutter for opening or closing an air outlet of the duct, and the drive controller controls start and stop of sending air from the air blower, by controlling opening and closing actions of the shutter, in addition to the air sending operation.

3. The postprocessing device according to claim 1, wherein the air blower includes a fan, and a duct that guides air emitted from the fan to the loading surface, and the duct is formed in a shape that emits air from the fan in a direction parallel to the loading surface, or inclined downward toward a downstream side in the transport direction.

4. The postprocessing device according to claim 1, wherein the drive controller identifies a printing method of the image forming apparatus, and performs the air sending operation when the identified printing method is ink jet printing, but keeps from performing the air sending operation, when the identified printing method is electrophotography.

5. The postprocessing device according to claim 1, wherein the drive controller of the postprocessing device receives an instruction from the image forming apparatus, and performs the air sending operation when the instruction indicates "on", but keeps from performing the air sending operation, when the instruction indicates "off".

6. The postprocessing device according to claim 1, further comprising a sheet sensor located at a position that makes a time for the recording sheet to reach the nip region equal to a time before the air blower completely stops sending air, after being turned off, wherein the drive controller turns on the air blower, when a leading edge of the second recording sheet passes the sheet sensor, and turns off the air blower, when a trailing edge of the second recording sheet passes the sheet sensor.

7. An image forming system comprising:

the postprocessing device according to claim 1; and an image forming apparatus including an image forming device that forms an image on a recording sheet, and a transport roller that transports the recording sheet on which the image has been formed, to the postprocessing device.

8. The image forming system according to claim 7, wherein the image forming apparatus further includes an operation device to which a user's instruction is inputted, and the drive controller of the postprocessing device receives the instruction inputted to the operation device, from the image forming apparatus, and performs the air sending operation when the instruction indicates "on", but keeps from performing the air sending operation, when the instruction indicates "off".

* * * * *